US010539123B2

(12) United States Patent
Turner et al.

(10) Patent No.: US 10,539,123 B2
(45) Date of Patent: Jan. 21, 2020

(54) PRESSURE REGULATING APPARATUS INCLUDING CONDUIT

(71) Applicant: Edwards Limited, Crawley, West Sussex (GB)

(72) Inventors: Neil Turner, Godalming (GB); Jack Raymond Tattersall, Victoria (AU); Alan Ernest Kinnaird Holbrook, Pulborough (GB); Matthew Richard Wickes, Hurstpierpoint (GB)

(73) Assignee: Edwards Limited, Burgess Hill (GB)

( * ) Notice: Subject to any disclaimer, the term of this patent is extended or adjusted under 35 U.S.C. 154(b) by 447 days.

(21) Appl. No.: 14/648,135

(22) PCT Filed: Oct. 28, 2013

(86) PCT No.: PCT/GB2013/052803

§ 371 (c)(1),
(2) Date: May 28, 2015

(87) PCT Pub. No.: WO2014/083307

PCT Pub. Date: Jun. 5, 2014

(65) Prior Publication Data

US 2015/0292494 A1 Oct. 15, 2015

(30) Foreign Application Priority Data

Nov. 30, 2012 (GB) ..... 1221575.2

(51) Int. Cl.
*F04B 11/00* (2006.01)
*F04B 37/14* (2006.01)
(Continued)

(52) U.S. Cl.
CPC ..... *F04B 11/0091* (2013.01); *F04B 37/14* (2013.01); *F04B 39/0055* (2013.01); *F04B 41/06* (2013.01)

(58) Field of Classification Search
CPC ..... F04C 18/126; F04C 29/06; F04C 29/061; F04C 29/065; F04C 28/28; F04C 29/124;
(Continued)

(56) References Cited

U.S. PATENT DOCUMENTS 3,743,443 A * 7/1973 Jennings ..... F04C 19/004 417/68
3,922,110 A * 11/1975 Huse ..... F04B 9/02 417/2

(Continued)

FOREIGN PATENT DOCUMENTS

CA 2581268 A1 11/2007
CN 1637283 A 7/2005

(Continued)

OTHER PUBLICATIONS

First Office Action and Search Report of State Intellectual Property Office, P.R. China dated Mar. 24, 2016.

(Continued)

*Primary Examiner* — Essama Omgba
*Assistant Examiner* — Stephen A Mick
(74) *Attorney, Agent, or Firm* — Shumaker & Sieffert, P.A.

(57) ABSTRACT

In situations where a vacuum system is suddenly overloaded, there is a risk of mechanical damage being sustained, for example, bearing damage, gear slippage or rotor and/or stator collisions. Sudden overloads can also lead to electrical damage, for example, over-currents or power surges. Therefore a pressure regulating apparatus is provided for use in a vacuum pumping system having an inlet, an outlet and a conduit interposed between, and in fluid communication with, the inlet and the outlet, wherein the cross- (Continued)

sectional area of the conduit is greater than that required to meet the conductance requirements of the inlet and the outlet.

15 Claims, 5 Drawing Sheets

(51) Int. Cl.
*F04B 41/06* (2006.01)
*F04B 39/00* (2006.01)

(58) Field of Classification Search
CPC .. F04C 25/02; F04B 11/0091; F04B 39/0055; F04B 37/14; F04B 41/06
USPC ..... 417/312, 540, 542, 543
See application file for complete search history.

(56) References Cited

U.S. PATENT DOCUMENTS

| | | | | |
|---|---|---|---|---|
| 5,290,152 | A * | 3/1994 | Wallace | F04C 19/008 134/22.11 |
| 5,725,364 | A * | 3/1998 | Mirazita | B05B 9/0403 137/884 |
| 6,257,835 | B1 | 7/2001 | Kaehler | |
| 6,474,949 | B1 * | 11/2002 | Arai | F04B 37/08 417/2 |
| 2003/0084662 | A1 * | 5/2003 | Haerr | B60T 13/567 60/397 |
| 2004/0163884 | A1 | 8/2004 | Austin et al. | |
| 2008/0193303 | A1 | 8/2008 | Stones | |
| 2012/0031518 | A1 * | 2/2012 | Smith | F03B 13/00 138/108 |
| 2012/0132800 | A1 * | 5/2012 | Stones | F04D 19/046 250/288 |

FOREIGN PATENT DOCUMENTS

| | | | |
|---|---|---|---|
| CN | 2767710 | Y | 3/2006 |
| DE | 379671 | C | 8/1923 |
| DE | 202004015599 | U1 | 2/2005 |
| EP | 0537051 | A1 | 4/1993 |
| EP | 1553303 | A2 | 7/2005 |
| EP | 2060861 | A1 | 5/2009 |
| EP | 2330299 | A1 | 6/2011 |
| GB | 2474507 | A | 4/2011 |
| JP | 2007127048 | A | 5/2007 |
| JP | 2011226368 | A | 11/2011 |
| WO | 03031823 | A1 | 4/2003 |

OTHER PUBLICATIONS

Translation of First Office Action and Search Report of State Intellectual Property Office, P.R. China dated Mar. 24, 2016.
Harris, Considerations in System Design, Modern Vacuum Practice, 3rd Edition, Chapter 13, pp. 317-345, 2005.
British Search Report and Examination Report dated Mar. 26, 2013 for corresponding British Application No. GB1221575.2.
PCT International Notification of Transmittal of the International Search Report and Written Opinion of the International Search Authority, or the Declaration, PCT International Search Report and PCT International Written Opinion dated Feb. 25, 2014 for corresponding PCT Application No. PCT/GB2013/052803.
International Preliminary Report on Patentability from International Application No. PCT/GB2013/052803, dated Jun. 2, 2015, 8 pp.
Examination Report from counterpart European Application No. 13783652.4, dated Oct. 5, 2017, 4 pp.

* cited by examiner

PRESSURE REGULATING APPARATUS INCLUDING CONDUIT

CROSS-REFERENCE TO RELATED APPLICATION

This Application is a Section 371 National Stage Application of International Application No. PCT/GB2013/052803, filed Oct. 28, 2013, which is incorporated by reference in its entirety and published as WO 2014/083307 A1 on Jun. 5, 2014 and which claims priority of British Application No. 1221575.2, filed Nov. 30, 2012.

FIELD OF THE INVENTION

This invention relates to improvements in and relating to vacuum conduits, and in particular, but without limitation, to conduits suitable for use in vacuum pumping systems.

BACKGROUND

Many industrial processes need to be carried out under vacuum and it is customary, in such situations, to carry out the process concerned in a chamber that is connected to a vacuum pump. Good design practice indicates connecting the inlet of a vacuum pump directly to the outlet orifice of a chamber being pumped, but this is not always possible or practical due to external design requirements, such as the need to fit the vacuum pumping system in around other components. Thus, conduits and manifolds are often used to provide fluid communication between the various components of a vacuum system. In order to efficiently obtain and sustain a vacuum, it is an accepted principle of vacuum system design (cf. "Modern Vacuum Practice", 3$^{rd}$ Edition, Nigel Harris, ISBN 0-9551501-1-6, chapter 13), that conduits should be as short and wide as possible. By following this rule, the conductance of the conduit can be maximised, thus reducing its resistive effect on the vacuum system.

In many vacuum systems, an isolator valve is interposed between the chamber being evacuated and the pumping system to enable the two to be isolated, for example, during loading of the chamber or during maintenance of the pumping system. As such, it is possible, and indeed quite commonplace, for an isolator valve to be used to temporarily, or semi-permanently, maintain the chamber and pumping system at different pressures. However, where a pressure differential exists and the isolator valve is subsequently opened, inevitably there will be a rush of gas from the chamber to the vacuum system or vice-versa, depending on the direction of the pressure gradient.

It is common knowledge that sudden rushes of gasses in vacuum systems are undesirable because they can overload, or cause damage to, the vacuum system's components. A further consideration is that a sudden rush of gas can exceed the pumping capacity of the vacuum system, which may not be able to cope with the increased throughput, that is to say, the quantity of gas passing through a cross-section in a given interval of time.

In situations where a vacuum system is suddenly overloaded, there is a risk of mechanical damage being sustained, for example, bearing damage, gear slippage or rotor and/or stator collisions. Sudden overloads can also lead to electrical damage, for example, over-currents or power surges.

In order to combat the above effects, it is well-established practice to include an in-line pressure regulating system to dampen or block sudden changes in throughput. One example of a known pressure regulating system comprises a mechanical regulator valve arrangement that is configured to limit the throughput of gas in a vacuum system above certain pressure differentials, but to allow relatively unimpeded flow of gas below the said pressure differentials. One of the drawbacks of known in-line pressure regulating systems is that they are complex devices that operate on mechanical principles and can thus be costly to install, maintain and repair.

A need therefore exists for an improved and/or alternative type of pressure regulating system, and in particular, one that can be suitably employed to safeguard against damage to vacuum pumping systems during opening of isolator valves.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect of the invention, there is provided a pressure regulating apparatus for use in a vacuum pumping system having an inlet, an outlet and a conduit interposed between, and in fluid communication with, the inlet and the outlet, wherein the cross-sectional area of the conduit is greater than that required to meet the conductance requirements of the inlet and the outlet.

According to a second aspect of the invention, there is provided a conduit for use in a vacuum pumping system having an inlet, an outlet and a conduit interposed between, and in fluid communication with, the inlet and the outlet, and further comprising a hollow expansion chamber in fluid communication with the conduit.

In a yet further aspect, the invention comprises a deliberately over-sized conduit locatable, in use, between two parts of a vacuum system, which provides excess free volume into which in-rush gasses can accumulate to reduce pressure increases during sudden in-rush events.

The invention suitably capitalises on the fact that the underlying cause of damage to vacuum pumping systems is often attributable to sudden changes in system pressure, rather than sudden changes in gas throughput. Thus, by providing an expansion chamber, or by making the cross-section area of the conduit larger than is dictated by the cross-sectional areas of the inlet and outlet, the change in pressure for a given increase in throughput or volume of gas in the system, can be reduced.

By providing excess free volume for in-rush gasses to expand into, the magnitude of sudden pressure changes can be reduced. Additionally or alternatively, by providing excess free volume for in-rush gasses to expand into, in-rush gas can be accumulated in the over-sized conduit or expansion chamber thus affording the pumping system time to accommodate the increased throughput requirement without overloading the vacuum system.

As stated previously, the general design rule of making conduits as short and wide as possible in vacuum systems is usually applied in a manner that ensures that the cross-sectional area of the main body of the conduit is as close as possible to that of conduit's inlet and outlet orifices. Any increase in the conduit's cross-section beyond that of the inlet and outlet does not increase the overall conductance, and is thus contraindicated, due to other competing requirements in vacuum system design. Specifically, it is usually desirable to reduce the size of vacuum system components to save weight and material usage. Also, larger internal volumes take longer to evacuate, and so one of the objects of vacuum system design is to minimise internal volumes to improve pumping efficiency. In addition, increasing the internal surface area of conduits generally leads to increases in process loads because large internal surface areas present larger areas for water vapour, contaminants and oxidation to tenaciously build-up on.

As such, the application of known vacuum pumping design principles dictates enlarging the bore of conduits to match the largest bore size of the inlet or outlet, but to increase them no further to minimise the deleterious effects outlined above.

Thus, it will be appreciated that it is neither established practice for the cross-sectional areas of vacuum system conduits to exceed those of the inlets or outlets, nor for the internal volume of vacuum system conduits to exceed the pressure, conductance or pumping requirements of connected vacuum pumping system. The invention thus departs from accepted design principles.

Nevertheless, it has been found that the deleterious effect of increasing the conduit's internal volume or surface area, or volume and surface area in the manner of the invention is, in many cases, more than offset by the advantages of avoiding a mechanical pressure regulating system, namely, fewer mechanical parts, reduced overall system complexity, rationalisation and so on.

The invention provides a conduit having an over-sized bore or an expansion chamber that functions as a pressure regulating element in a vacuum system.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

An embodiment of the invention shall now be described, by way of example only, with reference to the accompanying drawings in which.

DETAIL DESCRIPTION

Figure 1:
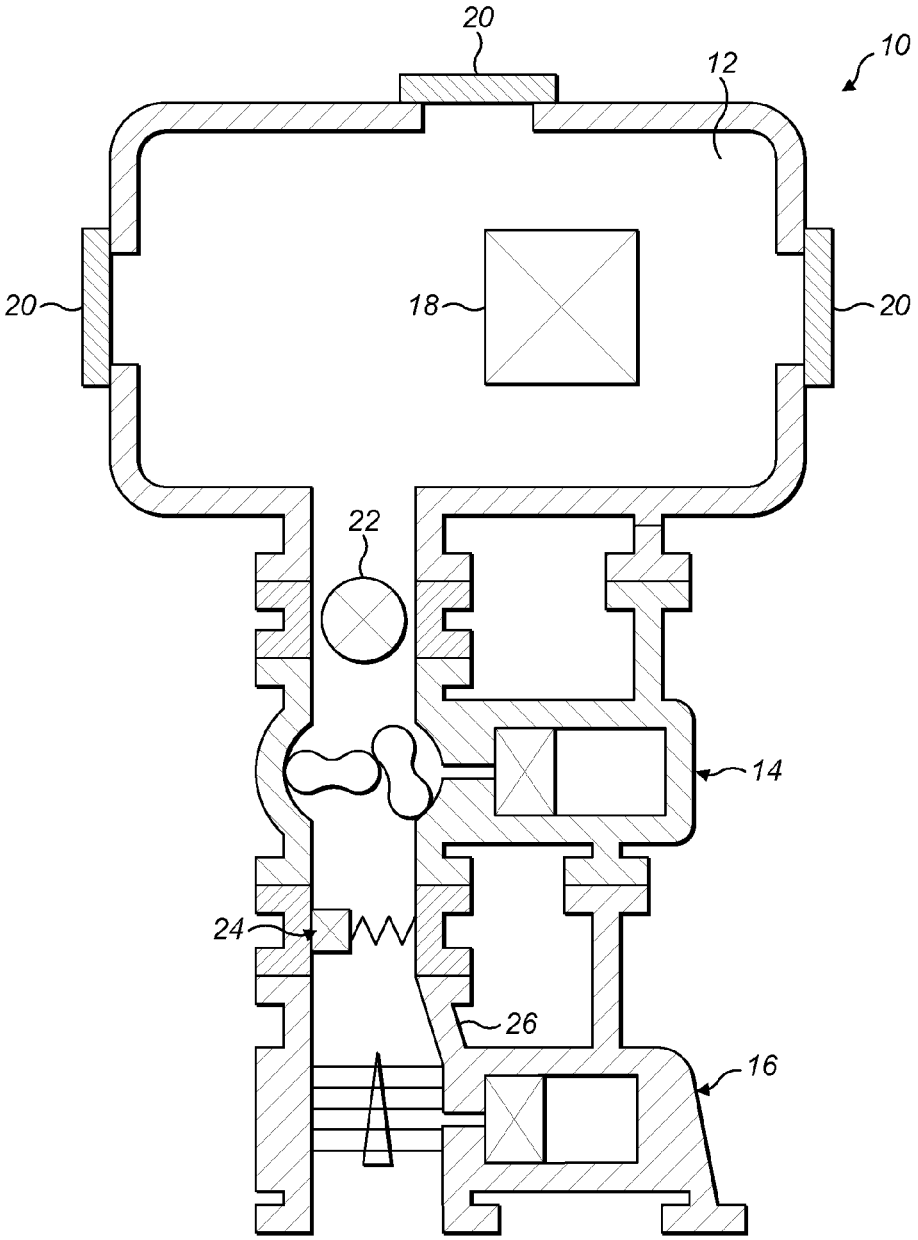
FIG. 1 (Prior Art)
FIG. 1 is a schematic cross-section of a known vacuum system fitted with a pressure regulating valve.

In a known vacuum pumping system 10, a vacuum chamber 12 is connected to a series of pumps 14, 16, that is to say, a booster pump 14 and a backing vacuum pump 16. The vacuum chamber 12 is where a process 18 is carried out, and the interior of the vacuum chamber 12 is accessible via any one or more sealingly-closeable access ports 20. An isolator valve 22 is interposed between the vacuum chamber 12 and the booster pump 14 to allow the two to be isolated from one another so that, for example, one of the access ports 20 can be opened without admitting air into the vacuum pumps 14, 16. Before the process 18 can get underway, the vacuum chamber 12 needs to be evacuate, and so the isolator valve 22 is opened slowly to allow air within the vacuum chamber 12 to be evacuated by the booster 14 and backing vacuum pumps 16 in succession.

When the isolator valve 22 is first opened, the air within the vacuum chamber 12 immediately begins to rush into the vacuum pumps, and if the isolator vale 22 is opened too quickly, excess pressure can build-up between the booster pump 14 and the backing vacuum pump 16 due the difference in their respective maximum throughputs. This can lead to back-pressure working against the booster pump 14 or too high a pressure at the inlet of the backing vacuum pump 16. To combat this, a pressure regulating device 24 is interposed between the booster pump 14 and the backing vacuum pump 16 to limit the pressure at the inlet of the booster pump 16 at the expense of increased back-pressure at the outlet of the booster pump 14 developed between the two pump. The pressure relief valve 24 is only shown schematically in FIG. 1, but it usually comprises a diverter conduit that is configured to divert gas back to the inlet side of the booster pump if the pressure on the outlet side exceeds a threshold value. An alternative approach is to use a valve to restrict the flow of process gas or air into the inlet of the booster pump in response to the surge in gas at the inlet. The operation of pressure regulating valves is well-known, and does not warrant detailed discussion here.

Figure 2:
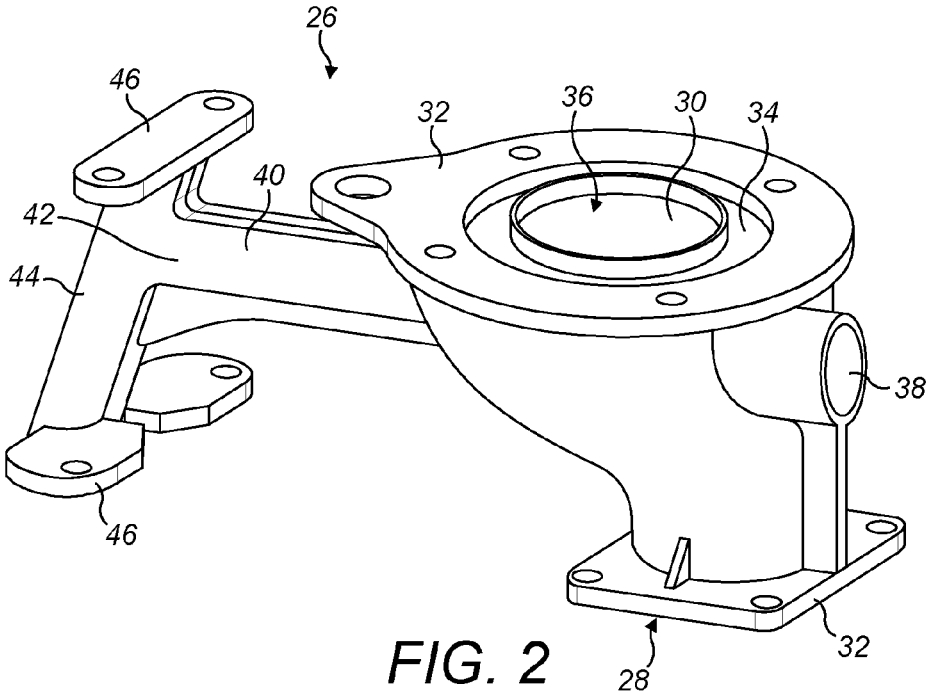
FIG. 2 (Prior Art)
FIG. 2 is a perspective view from above and one side of a known manifold for interconnecting a booster pump and a backing vacuum pump.
Figure 3:
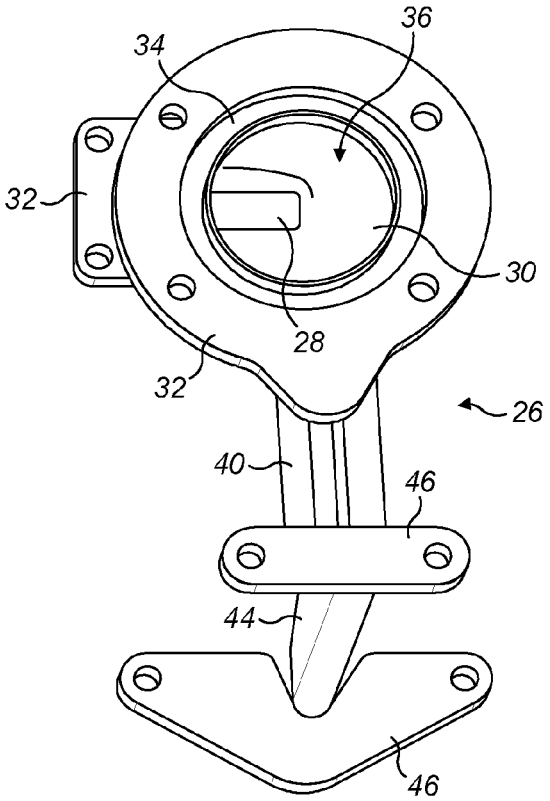
FIG. 3 (Prior Art)
FIG. 3 is a perspective view the manifold of FIG. 2 from above.

Booster and backing pumps are usually sold as pre-configured combinations, and so a manifold, such as that shown in FIGS. 2 and 3 is often employed to match the respective connection orifices when the two are shipped together. The manifold serves to provide a conduit between the outlet of the booster pump and the inlet of the backing pump having inlet and outlet orifices matching those of the respective pumps.

In FIGS. 2 and 3, such a known type of manifold 26 comprises an inlet orifice 30 and an outlet orifice 28 having flanged peripheries 32 that can be bolted to complimentarily-shaped and sized connection flanges of other components of the vacuum system in a known manner, for example using bolts and with a sealing gasket interposed between the respective flanges 32. The flanges 32 may additionally comprise recessed channels 34, such as that shown in FIG. 2 in particular, into which a seal or gasket (not shown) can seat.

A conduit 36 interconnects the inlet 30 and outlet 28 orifices, which is tapered and shaped to provide a smooth transition between the two. It will be noted that the cross-sectional area of the conduit 36 does not exceed that of the larger of the inlet 30 and outlet 28 orifice at any point along its length.

The manifold 26 additionally comprises an auxiliary port 38, in fluid communication with conduit 36 to which auxiliary equipment can be affixed (not shown). The internal diameter of the auxiliary port 38 is relatively small, compared with that of the larger of the inlet 30 and outlet 28 ports, and so its effect on the flow of gas through the conduit 36 is minimal Notably, the inlet 30 and outlet 28 orifices are arranged to overlap so that there is a clear "line of sight" through the manifold 26 thus minimising restriction to gas flow, in use.

The manifold comprises a solid side arm 40, which projects out from the side wall of the conduit 36 and which has at its distal end 42, a strut 44 that is used to transmit the weight of the pumps 14, 16, in a manner that is known. The strut 44 also carries flanged connector plates 46 at its opposite ends that bolt to structural mounting points of other equipment or the support chassis of the vacuum system 10.

The invention, as shown in FIGS. 4 to 7 of the drawings, differs from the known arrangement as described above, in several respects.

Figure 4:
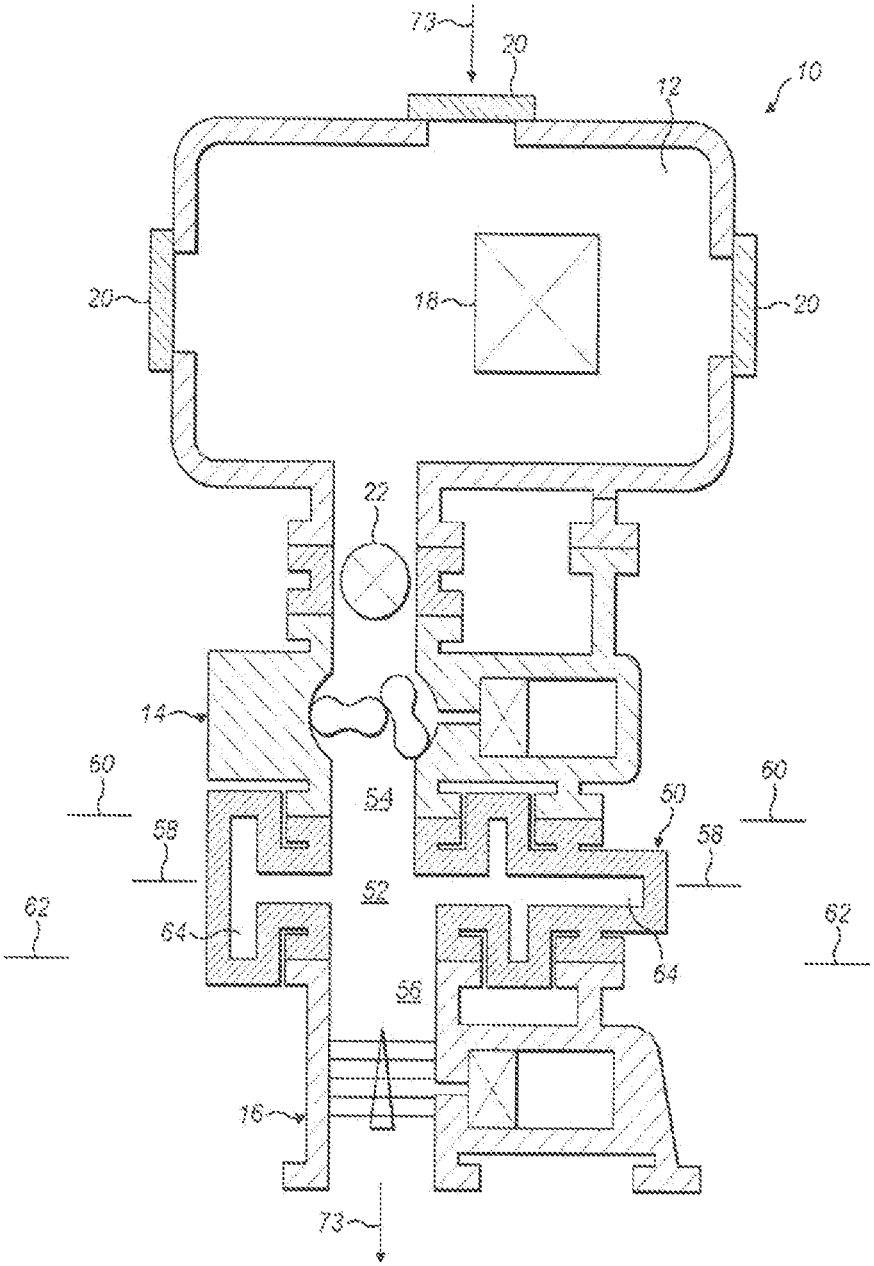
FIG. 4 is a schematic cross-section of a vacuum system fitted with a pressure-regulating manifold in accordance with the invention.

Turning now to FIG. 4, the vacuum system 10 comprises a vacuum chamber 12, isolator valve 22, booster pump 14 and backing pump 16 as previously described. However, instead of having a pressure-regulating valve 24, a new type of manifold 50 is used to connect the booster pump 14 to the backing vacuum pump 16. It will be noted from FIGS. 4 to 7 that the dimensions of the manifold's conduit 52 are considerably over-sized, compared to the respective dimensions of the booster pump's outlet 54 and the backing vacuum pump's inlet 56 orifices. Notably, the cross sectional area of the manifold 50 in a plane 58 lying between the plane of the inlet orifice 60 and the plane of the outlet orifice 62 is considerably larger than in the plane of the inlet orifice 60 or in the plane of the outlet orifice 62. In other words, the manifold of the invention 50 has an over-sized conduit 52 providing plenty of free volume 64 for in-rush gasses to occupy, thus reducing pressure build-up between the booster pump 14 and the backing vacuum pump 16, thereby obviating the need for a pressure-regulating valve 24 as previously described.

The size of the free volume 64, or the "expansion chamber" is maximised by shaping the manifold 50 of the invention to occupy the largest amount of space within the vacuum system 10, in the illustrated example, in the space between the booster pump 14 and the backing vacuum pump 16. The shape and configuration of the manifold 50 of the invention will, of course, need to be matched to particular pump configurations, but it will be appreciated that having a passive pressure-regulating manifold can be an advantage in many situations, compared with having a relatively complex and expensive, mechanical pressure-regulating valve 24.

Figure 5:
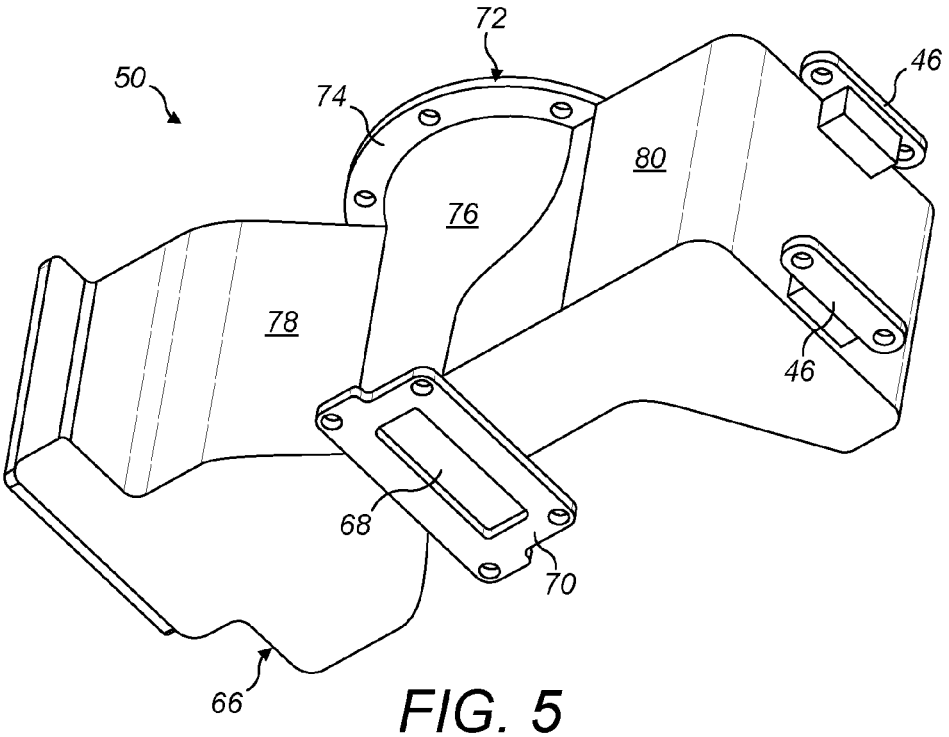
FIG. 5 is a perspective view from below and one side of a pressure-regulating manifold in accordance with the invention.
Figure 6:
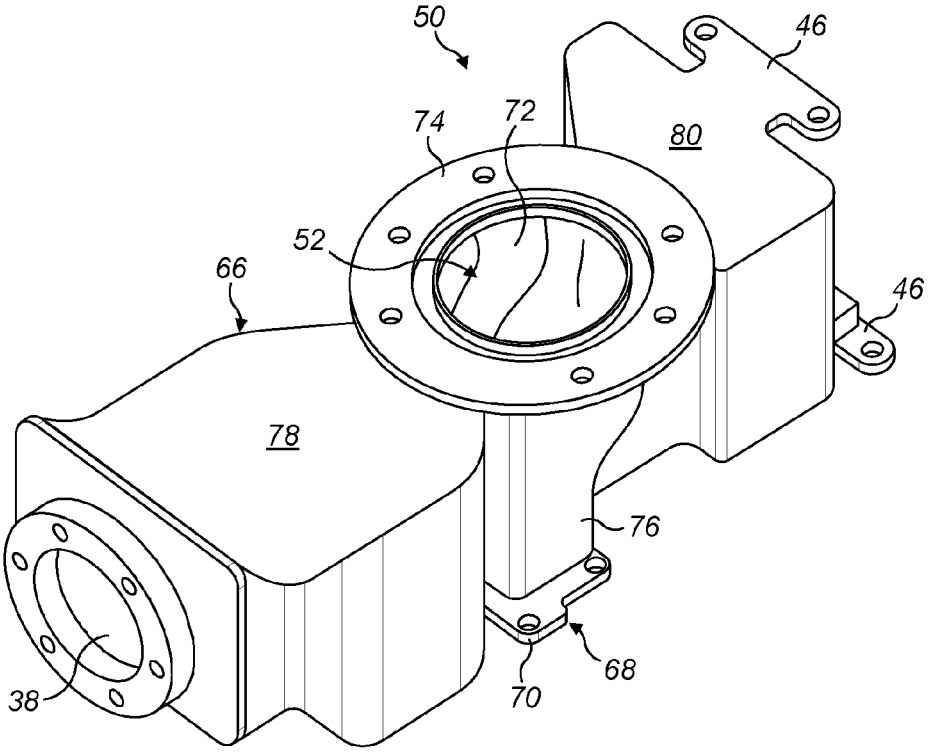
FIG. 6 is a perspective view of the manifold of FIG. 5 from above and one side.
Figure 7:
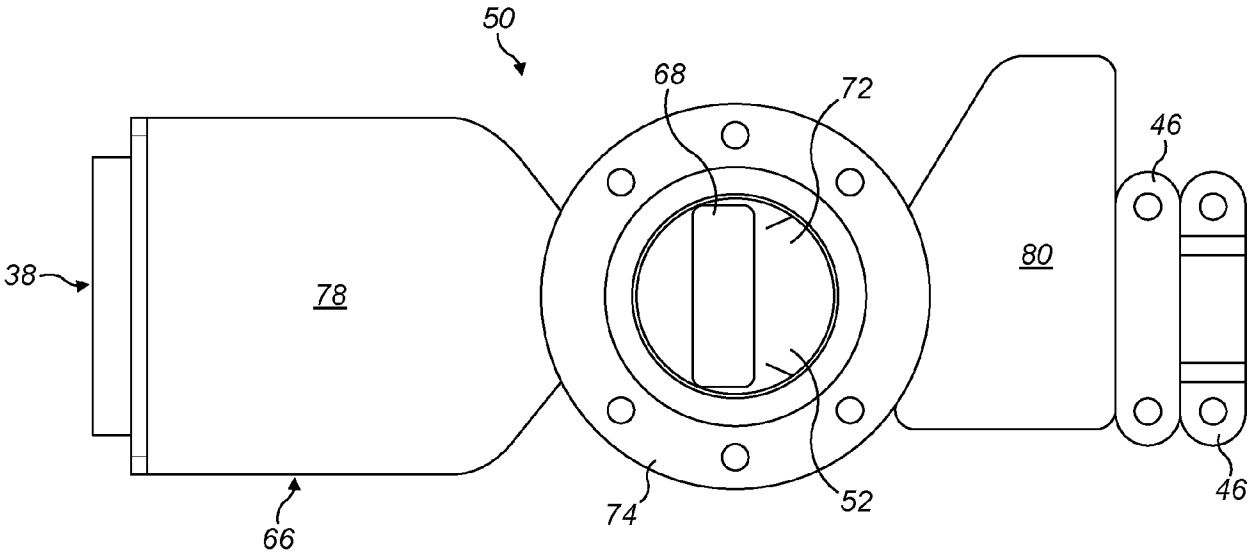
FIG. 7 is a perspective view from above of the manifold of FIGS. 6 and 6.

FIGS. 5 to 7 show one specific embodiment of a manifold in accordance with the invention, but it will be appreciated that the specifics of the design of the manifold 50 may need to be changed depending on user preferences, the vacuum system 10 configuration and the pressure and pumping requirements of a vacuum system 10 connected to the vacuum chamber 12.

In FIGS. 5, 6 and 7, the manifold 50 comprises a main body portion 66 formed generally as a hollow box using a metal casting process. The main body portion 66 comprises an inlet aperture 72 surrounded by inlet connection flange 74, which can be bolted, in use, to the outlet of a booster pump 14. It also comprises an outlet aperture 68, also surrounded by a connection flange 70 that can be bolted to the inlet of a backing vacuum pump 16. The main body portion 66 comprises a central conduit portion 76 that extends between the inlet 72 and outlet 68 apertures, which is internally shaped to provide a smooth and gradual transition between the shape and dimensions of the respective apertures 72, 68.

Extending sideward, and in fluid communication with the interior of the conduit portion 76 of the main body portion 66 are a pair of hollow expansion chamber portions 78, 80 that provide the aforementioned and described free volume 64 for in-rush gasses to be accumulated in. Thus, during a sudden in-rush event, the volume of in-rush gas is able to be accommodated within the hollow expansion chamber portions 78, 80 to reduce the pressure build-up that would otherwise have occurred had the hollow expansion chamber portions 78, 80 not been present.

It will be noted, from FIG. 7 in particular, that the inlet 68 and outlet 72 apertures are arranged to overlap to provide a direct "line of sight" 72 not only through the manifold 50 itself, but also through the entire vacuum system 10, if correctly configured, which improves pumping efficiency. By virtue of the direct line of sight 72 through the manifold 50 of the invention, the hollow expansion chamber portions 78, 80 located on either side of the conduit portion 76 play no significant role during normal operation of the vacuum pumping system 10 because gasses are able to pass unimpeded through the manifold 50, that is to say, directly from inlet 72 to outlet 68 without impinging on the side walls of the conduit 76 or without being entrained into the hollow expansion chamber portions 78, 80. Thus, under normal operating conditions, the manifold 50 is effectively invisible to the vacuum pumps 14, 16, in terms of added resistance, but provided ample free volume for in-rush gasses to expand into, or be accumulated in, during a sudden in-rush event, or in a situation where the output of the boosted pump 16 exceeds the intake of the backing vacuum pump 16.

The volume of the hollow expansion chamber portions 78, 80 is maximised by shaping them, as shown, to occupy the maximum possible free space within the vacuum system 10. Conveniently, the invention also reduces or removes the need for a solid side arm 40 carrying a strut 44 because the structural connection flanges 46 previously described can be readily integrated into, or bolted onto the exterior of, the hollow expansion chamber portions 78, 80, as shown in the drawings.

The manifold 50 of the invention additionally comprises an auxiliary port 38, such as that previously described, but given the increased frontage of the end of the hollow expansion chamber portions 78, 80, it is possible to make the auxiliary port much larger, which can be advantageous in many situations.

In the manifold shown in FIGS. 5, 6 and 7, the inlet diameter is 71 mm (having a cross-sectional area of 3959 $mm^2$ and the outlet is 61×26 mm (having a cross-sectional area of 1586 $mm^2$ The distanced between the inlet and the outlet, that is to say, the length of the conduit is 130 mm Therefore, the approximate volume of the conduit portion 74 of the manifold 50 is 360 $cm^3$. The internal volume of the entire interior of the manifold 50, that is to say, the conduit portion 76 and the two expansion chamber portions 78, 80, is approximately 2700 $cm^3$. The volume of the manifold is thus over-sized, in the illustrated example, by a factor of approximately 7.5, compared with that of a conventional manifold (such as that shown in FIGS. 2 and 3) that does not incorporate expansion chambers.

It will be apparent that there are practical upper and lower limits to the over-sizing of the manifold: the lower limit being over-sizing by a factor of approximately 2, whereby the volume of the expansion chamber portions 78, 80 will not provide a sufficiently-sized buffer for process gasses, and an upper limit dictated by the dimensions of the booster and backing pumps, or by the adverse effects of having too large a volume to pump down, of approximately 30. In practice, it will be desirable for the internal volume of the manifold to be as large as possible, given the physical constraints of the overall pump assembly, that is to say, the manifold will usually need to fit or nest in the available space between a booster pump and a backing pump.

In most cases, the internal volume of the manifold will be over-sized by a factor ranging from between approximately 5 and 20, and most preferably by a factor ranging from between 5 and 15 or 5 and 10, with an over-sizing by a factor of substantially 7.5 being used in many practical situations.

Another way to select the appropriate internal volume for the manifold is to consider the ratio of the booster and backing pump displacements. The greater the displacement of the booster in comparison with the backing pump, the larger the volume is required to be to accumulate the excess gas delivered by the booster. In addition, the greater the volume of gas to be evacuated from the process chamber, the larger the manifold volume needs to be. In practice it is found that the ratio of the free volume in the manifold (the combined volume of the conduit portion and the expansion chambers) to the largest anticipated process chamber volume should preferably be greater than 1% of the ratio of the booster displacement to backing pump displacement, and at least greater than 0.2% of ratio of displacements.

The manifold described above and shown in FIGS. 5, 6 and 7, is designed for chambers up to about 60 litres; i.e. the ratio of manifold to chamber volume is about 1/20. The ratio of the displacement of the booster to backing pump is about 10 (1400:140 $m^3h^{-1}$). Hence, in our design the ratio of the two volumes is about 0.5% of the ratio of the two displacements. The invention is not restricted to the details of the foregoing embodiments, which are merely exemplary of the invention. For example, the shape and configuration of the manifold, and in particular the conduit portion and the hollow expansion chamber portions 78, 80 can be changed to meet different physical and pumping requirements. Also the stated materials and methods of manufacture could be changed without departing from the scope of the invention.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A manifold suitable for connecting an outlet of a booster pump to an inlet of a backing pump, the manifold comprising:

a pressure regulating apparatus comprising:

an inlet comprising an inlet orifice;

an outlet comprising an outlet orifice;

a conduit interposed between, and in fluid communication with, the inlet and the outlet, wherein the cross-sectional area of the conduit is greater than that required to meet conductance requirements of the inlet and the outlet and is configured such that a free volume is provided to accommodate in-rush gases due to pressure differences in the system being pumped prior to the in-rush gases being transferred to the backing pump to thereby reduce pressure build-up between the booster pump and the backing pump during such an in-rush event, and wherein the inlet orifice and the outlet orifice are aligned to at least partially overlap when viewed along a direction, in use, of gas flowing through the pressure regulating apparatus such that there is a direct line of sight through the manifold;

a conduit portion having an inlet orifice sealingly connectable, in use, to the outlet of the booster pump, and an outlet orifice sealingly connectable, in use, to the inlet of the backing pump; and at least one expansion chamber portion in fluid communication with the conduit portion, wherein the combined volume of the conduit portion and the at least one expansion chamber portion is between approximately 2 and 30 times volume of the conduit portion.

2. The manifold as claimed in claim 1, wherein at least one of the inlet orifice or outlet orifice comprises a generally planar connection flange connectable, in use, to a connection flange of the booster or backing pump.

3. The manifold as claimed in claim 1, wherein the combined volume of the conduit portion and the at least one expansion chamber portion is between approximately 5 and 20 times the volume of the conduit portion.

4. The manifold as claimed in claim 1, wherein the combined volume of the conduit portion and the at least one expansion chamber portion is between approximately 5 and 15 times the volume of the conduit portion.

5. The manifold as claimed in claim 1, wherein the combined volume of the conduit portion and the at least one expansion chamber portion is between approximately 5 and 10 times the volume of the conduit portion.

6. The manifold as claimed in claim 1, wherein the combined volume of the conduit portion and the at least one expansion chamber portion is approximately 7.5 times the volume of the conduit portion.

7. The manifold as claimed in claim 1, wherein the ratio of the combined interior free volume of the conduit portion and the at least one expansion chamber portion to the largest anticipated process chamber volume is at least 0.2% of the ratio of the booster displacement to backing pump displacement.

8. The manifold as claimed in claim 1, wherein the ratio of the combined interior free volume of the conduit portion and the at least one expansion chamber portion to the largest anticipated process chamber volume is at least 1% of the ratio of the booster displacement to backing pump displacement.

9. The manifold as claimed in claim 1, wherein the manifold comprises a main body portion formed generally as a hollow box by a metal casting process.

10. The manifold as claimed in claim 1, wherein the conduit portion is internally shaped to provide a smooth and gradual transition between the shape and dimensions of the inlet and outlet apertures.

11. The manifold as claimed in claim 1, wherein the at least one hollow expansion chamber portion extends radially outwardly from the conduit portion.

12. The manifold according to claim 1, further comprising an auxiliary port in fluid communication with the conduit portion.

13. The manifold as claimed in claim 12, wherein the auxiliary port is formed as a through aperture in a side wall of one of the at least one expansion chamber.

14. The manifold according to claim 1, wherein a main body portion of the manifold comprises a structural support member for connection to either or both of the booster pump and the backing pump.

15. A vacuum system comprising:

a booster pump comprising an outlet;

a backing pump comprising an inlet; and a pressure regulating apparatus comprising:

an inlet comprising an inlet orifice;

an outlet comprising an outlet orifice;

a conduit interposed between, and in fluid communication with, the inlet and the outlet, wherein the cross-sectional area of the conduit is greater than that required to meet conductance requirements of the inlet and the outlet and is configured such that a free volume is provided to accommodate in-rush gases due to pressure differences in the system being pumped prior to the in-rush gases being transferred to the backing pump to thereby reduce pressure build-up between the booster pump and the backing pump during such an in-rush event, wherein the inlet orifice and the outlet orifices are aligned to at least partially overlap when viewed along a direction, in use, of the gas flowing through the pressure regulating apparatus such that there is a direct line of sight through the pressure regulating apparatus, and wherein the inlet of the pressure regulating apparatus is connected to, and in fluid communication with, the outlet of the booster pump and the outlet of the pressure regulating apparatus is connected to, and in fluid communication with, the inlet of the backing pump;

a conduit portion having an inlet orifice sealingly connectable, in use, to the outlet of the booster pump, and an outlet orifice sealingly connectable, in use, to the inlet of the backing pump; and at least one expansion chamber portion in fluid communication with the conduit portion, wherein the combined volume of the conduit portion and the at least one expansion chamber portion is between approximately 2 and 30 times volume of the conduit portion.

* * * * *